US007430385B2

(12) United States Patent
Yamaoka

(10) Patent No.: US 7,430,385 B2
(45) Date of Patent: Sep. 30, 2008

(54) IMAGE FORMING DEVICE WITH CARRYING MEMBER PROVIDED IN DOOR POSITIONED TO PHOTOCONDUCTIVE DRUM

(75) Inventor: Masanori Yamaoka, Osaka (JP)

(73) Assignee: Funai Electric Co., Ltd., Osaka (JP)

( * ) Notice: Subject to any disclaimer, the term of this patent is extended or adjusted under 35 U.S.C. 154(b) by 315 days.

(21) Appl. No.: 11/266,997

(22) Filed: Nov. 4, 2005

(65) Prior Publication Data

US 2006/0093397 A1 May 4, 2006

(30) Foreign Application Priority Data

Nov. 4, 2004 (JP) ..... 2004-320457

(51) Int. Cl.
*G03G 15/00* (2006.01)

(52) U.S. Cl. ..... 399/110; 399/114

(58) Field of Classification Search ..... 399/107, 399/108, 109, 110, 114, 121, 124, 125
See application file for complete search history.

(56) References Cited

U.S. PATENT DOCUMENTS 6,144,822 A * 11/2000 Yamaguchi et al. ..... 399/121

FOREIGN PATENT DOCUMENTS

JP 4-66963 3/1992
JP 10-301462 11/1998
JP 2000-231321 8/2000

OTHER PUBLICATIONS

Patent Abstracts of Japan, Publication No. 10-301462 dated Nov. 13, 1998 (1 page).
Japanese Office Action for Patent Application No. 2004-320457, Mailed Jun. 3, 2008, and English translation thereof, 4 pages.
Patent Abstracts of Japan for Japanese Patent Application No. 04-066963, Date of Publication: Mar. 3, 1992, 1 page.
Patent Abstracts of Japan for Japanese Patent Application No. 2000-231321, Date of Publication: Aug. 22, 2000, 1 page.

* cited by examiner

*Primary Examiner*—Hoan H Tran
(74) *Attorney, Agent, or Firm*—Osha Liang LLP

(57) ABSTRACT

An image forming device is obtained in which a carrying member provided at an openable/closable door can accurately be positioned to a photoconductive drum. A printer includes a housing having an openable/closable door, a drum as a photoconductive drum for image formation, a guide member, and a transfer roll. The drum is arranged inside the housing at a part adjacent to the door. The guide member has a fixed relative position to the drum. The transfer roll is provided at the door and arranged to be adjacent to the drum when the door is in a closed state. A guide convex portion and a guide groove of the guide member are formed as a position determining portion for determining the position of the transfer roll such that the relative position of the transfer roll to the guide member is fixed when the door is in a closed state.

7 Claims, 8 Drawing Sheets

IMAGE FORMING DEVICE WITH CARRYING MEMBER PROVIDED IN DOOR POSITIONED TO PHOTOCONDUCTIVE DRUM

BACKGROUND OF THE INVENTION

1. Field of the Invention

The present invention relates to an image forming device, and more particularly to an image forming device with a transfer roll.

2. Description of the Background Art

An image forming device that transfers a toner image formed on a photoconductive drum to transfer paper is conventionally known. In such an image forming device, a carrying member such as a transfer roll or a belt mechanism arranged to be adjacent to a photoconductive drum is used to carry transfer paper to the photoconductive drum. It is known that such a carrying member is attached to a door provided in an openable/closable manner to a housing of an image forming device in order to easily check or remove jammed transfer paper when a transfer paper jam occurs in the vicinity of a photoconductive drum (for example, Japanese Patent Laying-Open No. 10-301462).

The aforementioned image forming device, however, has the following problem. Specifically, a carrying member needs to be positioned accurately relative to a photoconductive drum (for example, the axes of the photoconductive drum and the transfer roll are arranged parallel to each other) in order to accurately carry transfer paper to the photoconductive drum. This is because inaccurate positioning of the carrying member to the photoconductive drum causes an error in which transfer paper is not correctly supplied to the photoconductive drum (for example, transfer paper is supplied at an angle to the axis of the photoconductive drum). However, when a carrying member such as a transfer roll is provided at an openable/closable door as described above, it has been difficult to accurately position the carrying member to the photoconductive drum in this way.

SUMMARY OF THE INVENTION

An object of the present invention is to provide an image forming device in which a carrying member provided at an openable/closable door can be positioned accurately to a photoconductive drum.

An image forming device in accordance with the present invention includes a housing having an openable/closable door, a photoconductive drum for image formation, a guide member, a transfer roll, and a pressurizing member. The photoconductive drum is arranged inside the housing at a part adjacent to the door. The photoconductive drum has a shaft serving as a center of rotation. The guide member has a groove. The transfer roll is held in a holding member provided at the door. The transfer roll is arranged to be adjacent to the photoconductive drum when the door is in a closed state. The pressurizing member pressurizes the transfer roll to a direction of the photoconductive drum. An end portion of the shaft of the photoconductive drum is fixedly inserted into the groove whereby a relative position between the guide member and the photoconductive drum is fixed. The holding member is provided with a convex portion. The convex portion of the holding member is inserted to be fixed in the groove such that a relative position of the transfer roll to the guide member is fixed when the door is in a closed state. The door pivots about a connection portion with the housing so that the door can be opened and closed. The connection portion includes a connecting convex portion formed at the housing, and an opening portion formed at the door for fixedly inserting the connecting convex portion. A width of the opening portion in a direction that intersects a pivoting direction of the door is greater than a width of the opening portion in a direction along the pivoting direction of the door.

In another aspect, an image forming device in accordance with the present invention includes a housing having an openable/closable door, a photoconductive drum for image formation, a guide member, and a carrying member. The photoconductive drum is arranged inside the housing at a part adjacent to the door. The guide member has a relative position to the photoconductive drum being fixed. The carrying member is provided at the door and arranged to be adjacent to the photoconductive drum when the door is in a closed state. A position determining portion for determining a position of the carrying member is formed such that a relative position of the carrying member to the guide member is fixed when the door is in a closed state.

In accordance with the present invention, a relative position of a carrying member such as a transfer roll provided at an openable/closable door with respect to a photoconductive drum can easily be determined through a guide member by forming a position determining portion.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
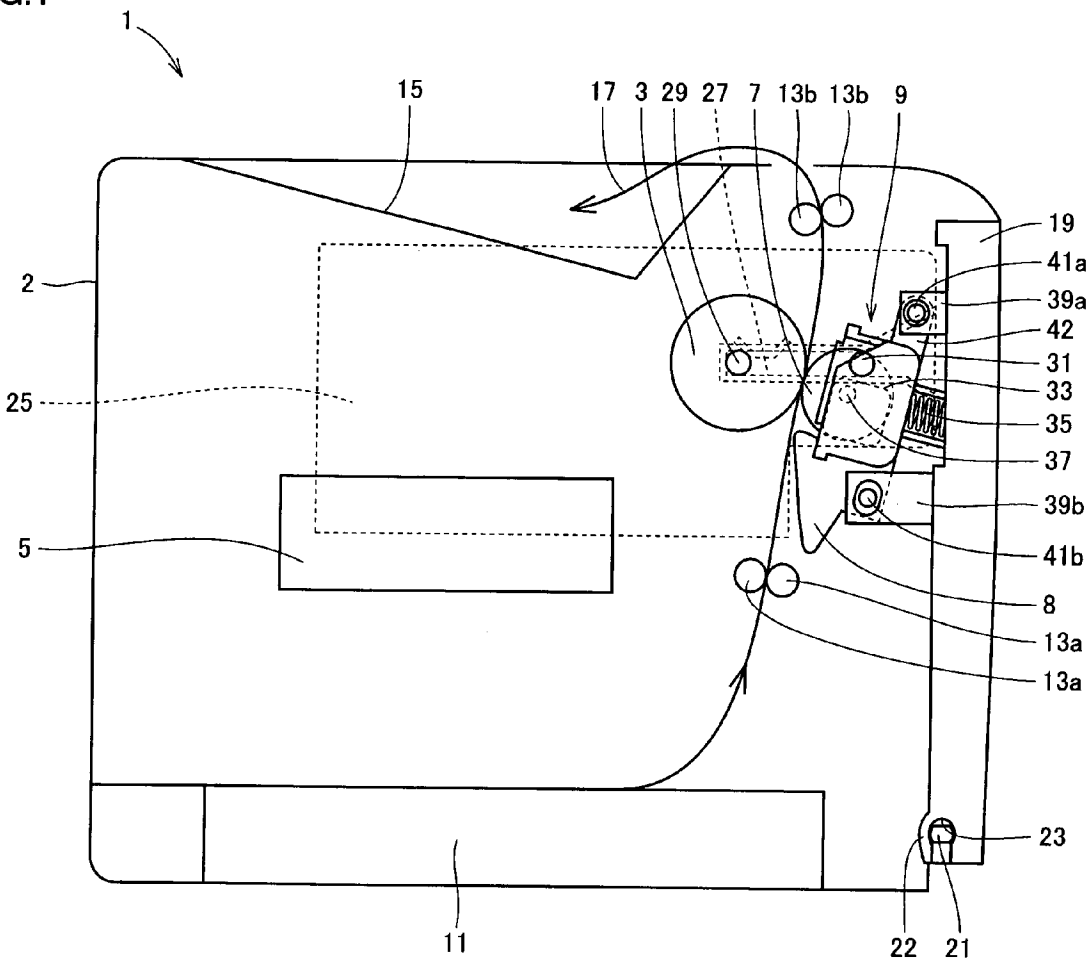
FIG. 1 is a schematic cross-sectional view showing a first embodiment of a printer as an exemplary image forming device in accordance with the present invention.

In the following, embodiments of the present invention will be described with reference to the drawings. It is noted in the following figures the same or corresponding parts will be denoted with the same reference numerals and the description thereof will not be repeated.

First Embodiment

Referring to FIGS. 1-4, a first embodiment of a printer in accordance with the present invention will be described.

As shown in FIG. 1, a printer 1 includes a drum 3 inside a housing 2, a pair of guide members 25 for fixing drum 3, a toner unit 5 for supplying toner to the surface of the drum 3, a transfer roll unit 9 including a transfer roll 7 arranged in contact with drum 3, a paper feed tray 11, and guide rollers 13*a* and 13*b* for carrying paper supplied from paper feed tray 11 to drum 3 and discharging paper having an image formed thereon to the outside of printer 1. On the back of housing 2 of printer 1, a door 19 is provided which can be opened and closed around a pivot 21 provided at housing 2 of printer 1. A door connection portion 22 is arranged at the bottom of the door 19. The door connection portion 22 has an opening portion 23 for inserting the above-noted pivot 21. Pivot 21 is inserted into the opening portion 23 so that door 19 is connected to housing 2 in an openable/closable manner around the pivot 21.

Figure 2:
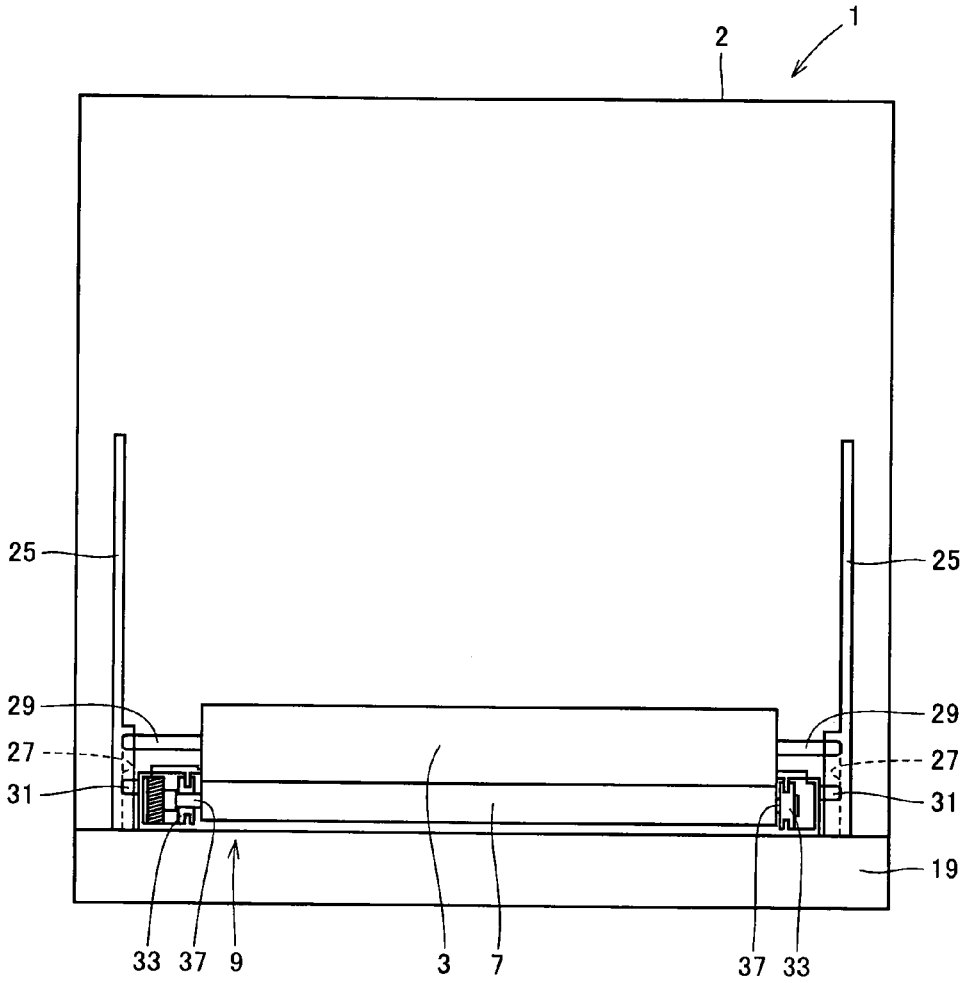
FIG. 2 is a schematic plan view illustrating an internal structure of the-printer as viewed from above the printer shown in FIG. 1.

As shown in FIG. 2, a pair of guide members 25 described above are arranged such that drum 3 inside housing 2 of printer 1 is sandwiched therebetween. A guide groove 27 is formed in the guide member 25. An end portion of a drum shaft 29 serving as the center of rotation of drum 3 is fixedly inserted in the guide groove 27. As a result, the relative position between drum 3 and guide member 25 is fixed.

In printer 1 as shown in FIGS. 1-4, recording paper supplied from paper feed tray 11 is supplied between drum 3 and transfer roll 7 through guide roller 13*a*. A toner image formed on drum 3 by means of toner is transferred to the recording paper. Then, after the photographic fixing process of the toner image transferred onto the recording paper, guide roller 13*b* allows the recording paper having the image formed thereon to be discharged to a concave portion 15 on the top surface of printer 1, as indicated by an arrow 17.

Figure 3:
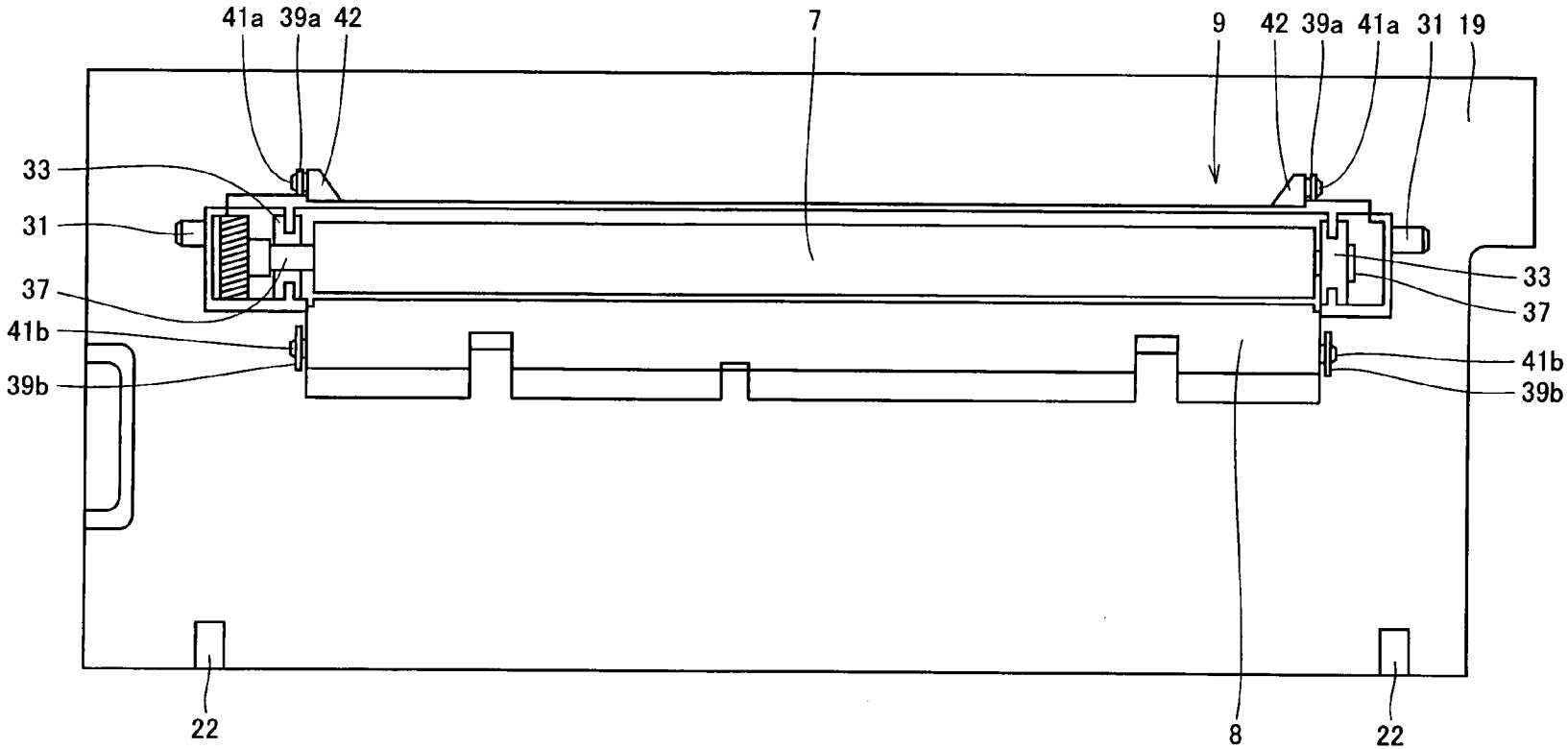
FIG. 3 is a schematic view illustrating a configuration of a door of the printer shown in FIG. 1.

The above-noted transfer roll unit 9 including transfer roll 7 is fixedly connected to the inside of door 19. Specifically, as shown in FIG. 3, transfer roll unit 9 has extension portions 42 formed at the top of both ends thereof The tip end portion of extension portion 42 has a fixing convex portion 41*a* for fixing transfer roll unit 9 to door 19. In addition, transfer roll unit 9 has a guide 8 formed at the lower portion thereof Fixing convex portions 41*b* are formed at both ends of guide 8 for fixedly connecting transfer roll unit 9 to door 19. Convex-shaped fixing portions 39*a*, 39*b* are formed at door 19 at positions opposing to the fixing convex portions 41*a*, 41*b*, respectively. The fixing portions 39*a*, 39*b* each have an opening portion. Fixing convex portions 41*a*, 41*b* of transfer roll unit 9 are fixedly inserted into the opening portions of fixing portions 39*a*, 39*b*, respectively, so that transfer roll unit 9 is connected to door 19.

In transfer roll unit 9, transfer roll 7 is arranged above guide 8. Roll shafts 37 serving as the axis of rotation of transfer roll 7 are rotatably held in shaft fixing members 33 arranged such that transfer roll 7 is sandwiched therebetween. The shaft fixing member 33 is fixedly connected to the housing of transfer roll unit 9. As is clear from FIG. 4, in transfer roll unit 9, a spring 35 is arranged between transfer roll 7 and door 19. The spring 35 is arranged to pressurize transfer roll 7 in the direction of drum 3. The spring 35 may be configured, for example, to pressurize shaft fixing member 33 holding roll shaft 37 of transfer roll 7. It is noted that any other member such as an elastic body may be used other than spring 35 as long as it is a biasing member that can apply stress to transfer roll 7 and that spring 35 may pressurize any portion other than shaft fixing member 33.

Figure 4:
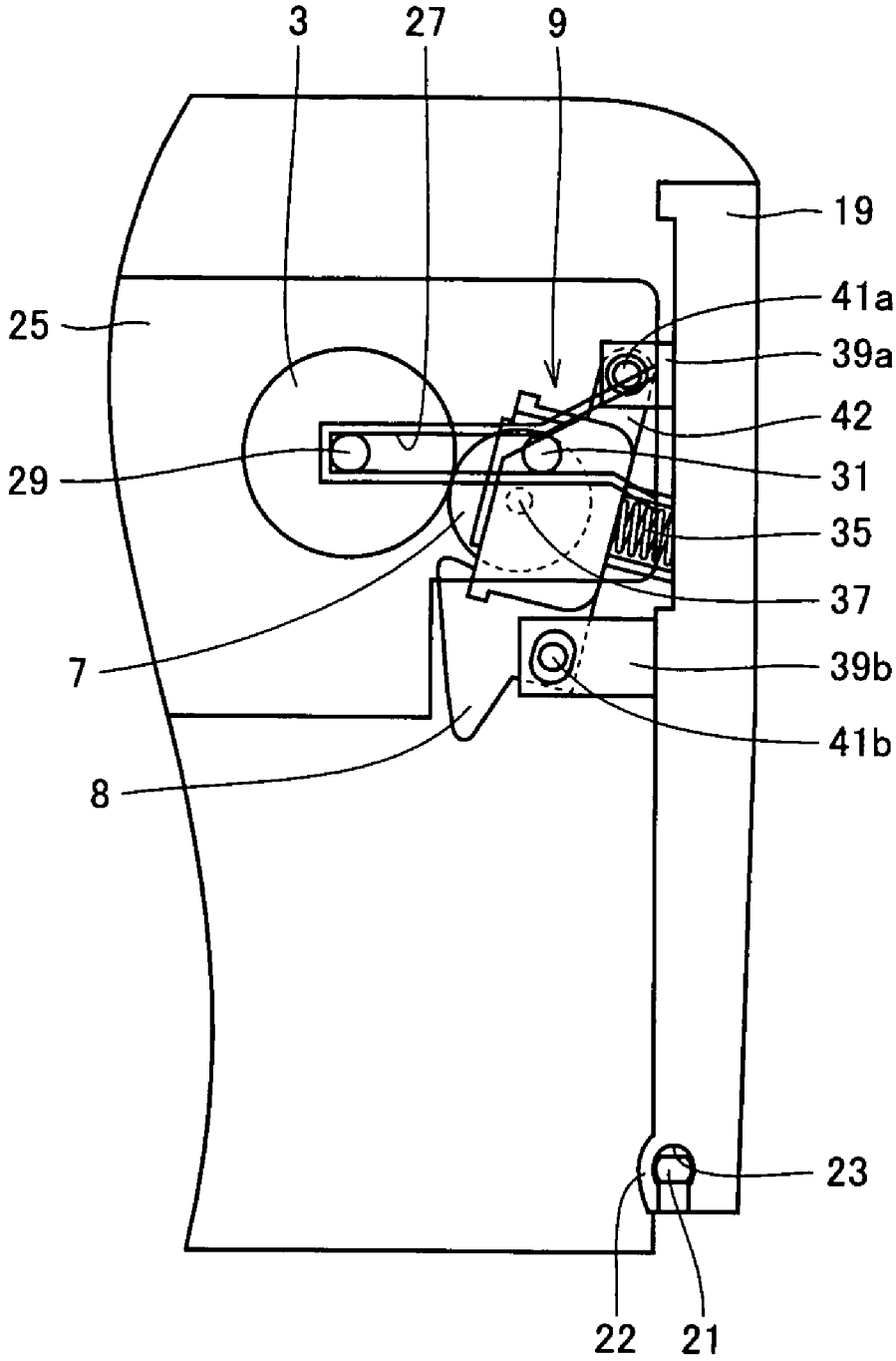
FIG. 4 is a partially-enlarged schematic view of the schematic cross-sectional view of the printer shown in FIG. 1.

Then, the aforementioned transfer roll unit 9 has guide convex portions 31 formed at both ends thereof such that transfer roll 7 is sandwiched therebetween. The guide convex portion 31 is fixedly inserted into guide groove 27 of guide member 25, as shown in FIG. 4. As a result, the relative position of transfer roll 7 to guide member 25 can be fixed. Therefore, the relative position between drum 3 and transfer roll 7 can be accurately fixed through guide member 25.

An opening/closing operation of door 19 will now be described.

Figure 5:
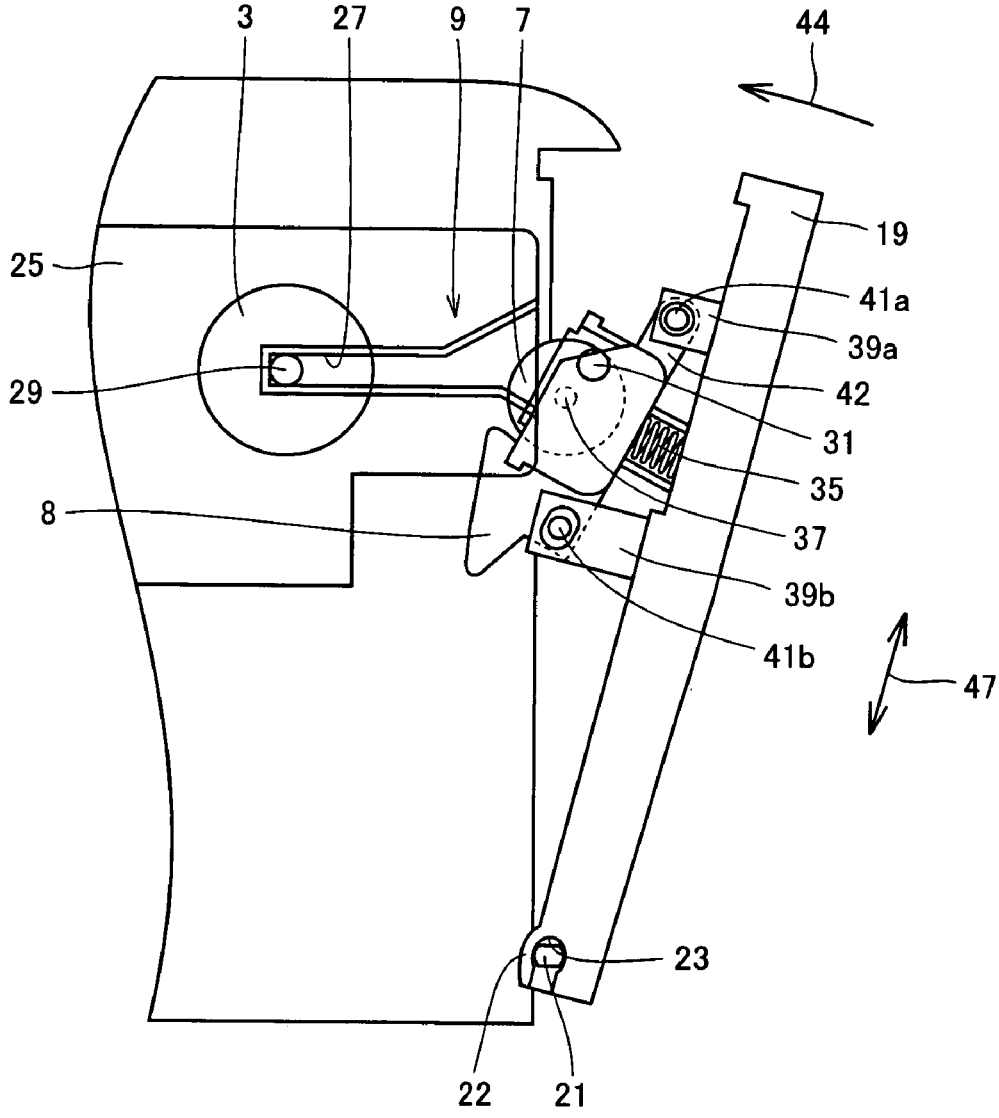
FIG. 5 is a schematic cross-sectional view illustrating an opened/closed state of the door in the printer shown in FIG. 1.

As is clear from FIG. 5, door 19 pivots in the direction indicated by an arrow 44 so that door 19 can change from an opened state to a closed state. Here, guide convex portion 31 formed at transfer roll unit 9 is inserted into guide groove 27 of guide member 25 arranged inside housing 2 of printer 1. Furthermore, since opening portion 23 formed at door connection portion 22 of door 19 is formed in an elongated manner along the direction in which door 19 extends (the direction that intersects the direction indicated by arrow 44, which is the direction in which door 19 pivots), door 19 can vary in position in the direction indicated by an arrow 47 during a pivoting movement of door 19 as indicated by arrow 44. Therefore, when door 19, transfer roll unit 9, or guide member 25 has any dimensional deviation, the position of door 19 can be adjusted finely in the direction indicated by arrow 47. Thus, when door 19 is in a closed state, guide convex portion 31 of transfer roll unit 9 can surely be inserted into guide groove 27 of guide member 25.

The structure of the connection portion between door 19 and housing 2 will now be described with reference to FIGS. 6 and 7.

Figure 6:
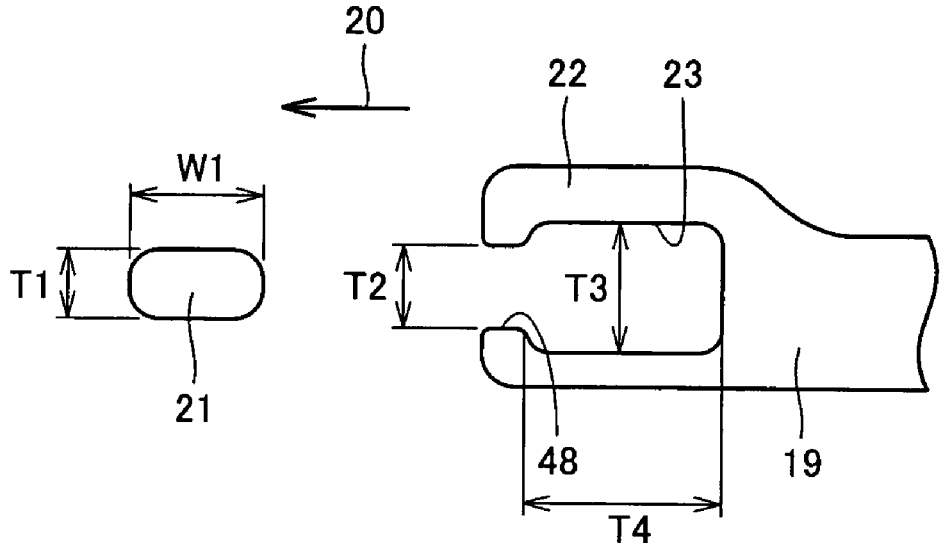
FIG. 6 is a schematic view showing a pivot formed in a housing of the printer and a connection portion of the door.

As is clear from FIG. 6, opening portion 23 formed in door connection portion 22 of door 19 has a vertically-long shape that is elongated in the door 19 extending direction. Specifically, a width T4 in the door-extending direction of opening portion 23 is greater than a width T3 of opening portion 23 in the direction vertical to the door 19 extending direction. An insertion slot 48 is formed at the lower end of door connection portion 22 for inserting pivot 21 to the inside of opening portion 23. A width T2 of insertion slot 48 is smaller than the above-noted width T3 of opening portion 23.

On the other hand, pivot 21 is shaped like a rectangular in which a width WI is greater than a height T1. It is noted that width T2 of insertion slot 48 formed at the lower portion of door connection portion 22 as described above is greater than height T1 of pivot 21. Therefore, pivot 21 can be inserted to the inside of opening portion 23 by relatively moving door 19 in the direction indicated by an arrow 20.

Figure 7:
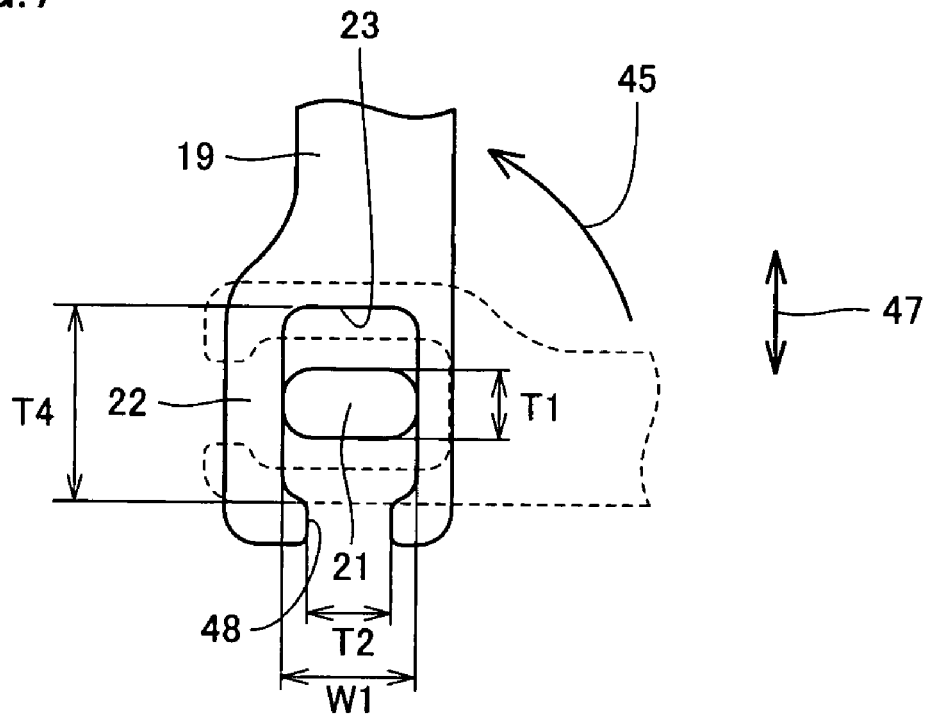
FIG. 7 is a schematic view showing that the pivot formed in the housing is inserted into an opening portion in the connection portion formed at the door.

Then, after inserting pivot 21 to the inside of opening portion 23, door 19 is rotated as indicated by an arrow 45 shown in FIG. 7 around pivot 21. As a result, as shown in FIG. 7, door 19 can be connected to housing 2 of printer 1 with pivot 21 being inserted inside opening portion 23. Here, pivot 21 does not come off from opening portion 23 through the insertion slot 48 since width T2 of insertion slot 48 of door connection portion 22 in door 19 is smaller than width W1 of pivot 21. Furthermore, width T3 of opening portion 23 of door connection portion 22 is greater than width W1 of pivot 21. Width T4 in the door 19 extending direction of opening portion 23 is greater than height T1 of pivot 21. Therefore, door 19 is movable in the direction indicated by arrow 47. Accordingly, as shown in FIG. 5, when door 19 pivots, door 19 can move in the direction that intersects its pivoting direction (the direction indicated by arrow 47).

It is noted that the structure of the connection portion between door 19 and housing 2 of printer 1 as described above is only an example, and any other connection structure may be employed as long as door 19 is movable in the direction that intersects its pivoting direction (the direction indicated by arrow 47).

The characteristic structure of printer 1 as described above can be summarized as follows: printer 1 as an image forming device in accordance with the present invention includes housing 2 having an openable/closable door 19, drum 3 as a photoconductive drum for forming an image, guide member 25, transfer roll 7, and spring 35 as a pressurizing member. Drum 3 is arranged inside housing 2 at a part adjacent to door 19. Drum 3 has drum shaft 29 serving as the axis about which drum 3 rotates. Guide member 25 has guide groove 27 formed as a groove. Transfer roll 7 is held in transfer roll unit 9 as a holding member provided at door 19. Transfer roll 7 is arranged to be adjacent to drum 3 when door 19 is in a closed state. Spring 35 pressurizes transfer roll 7 in the direction of drum 3. The end portion of drum shaft 29 of drum 3 is fixedly inserted in guide groove 27, so that the relative position between guide member 25 and drum 3 is fixed. Transfer roll unit 9 has guide convex portion 31 formed as a convex portion. When door is in a closed state, guide convex portion 31 of transfer roll unit 9 is inserted to be fixed in guide groove 27 such that the relative position of transfer roll 7 to guide member 25 is fixed. Door 19 pivots about the connection portion with housing 2 so that it can be opened and closed. The connection portion includes pivot 21 as a connecting convex portion formed at housing 2, and opening portion 23 for fixedly inserting pivot 21. Width T4 of opening portion 23 in the direction that intersects the pivoting direction of door 19 (the direction indicated by arrow 47 in FIG. 7) is greater than width T3 of opening portion 23 in the direction along the pivoting direction of door 19.

In this manner, in the configuration in which transfer roll 7 is provided to door 19, the relative position between drum 3 and transfer roll 7 can easily be determined through guide member 25. Therefore, such inconvenience can be prevented in that the position between transfer roll 7 and drum 3 is shifted (for example, shifted from the state in which the axes of transfer roll 7 and drum 3 are parallel to each other) to cause recording paper to be incorrectly supplied to drum 3 (for example, supplied at an angle).

Second Embodiment

Figure 8:
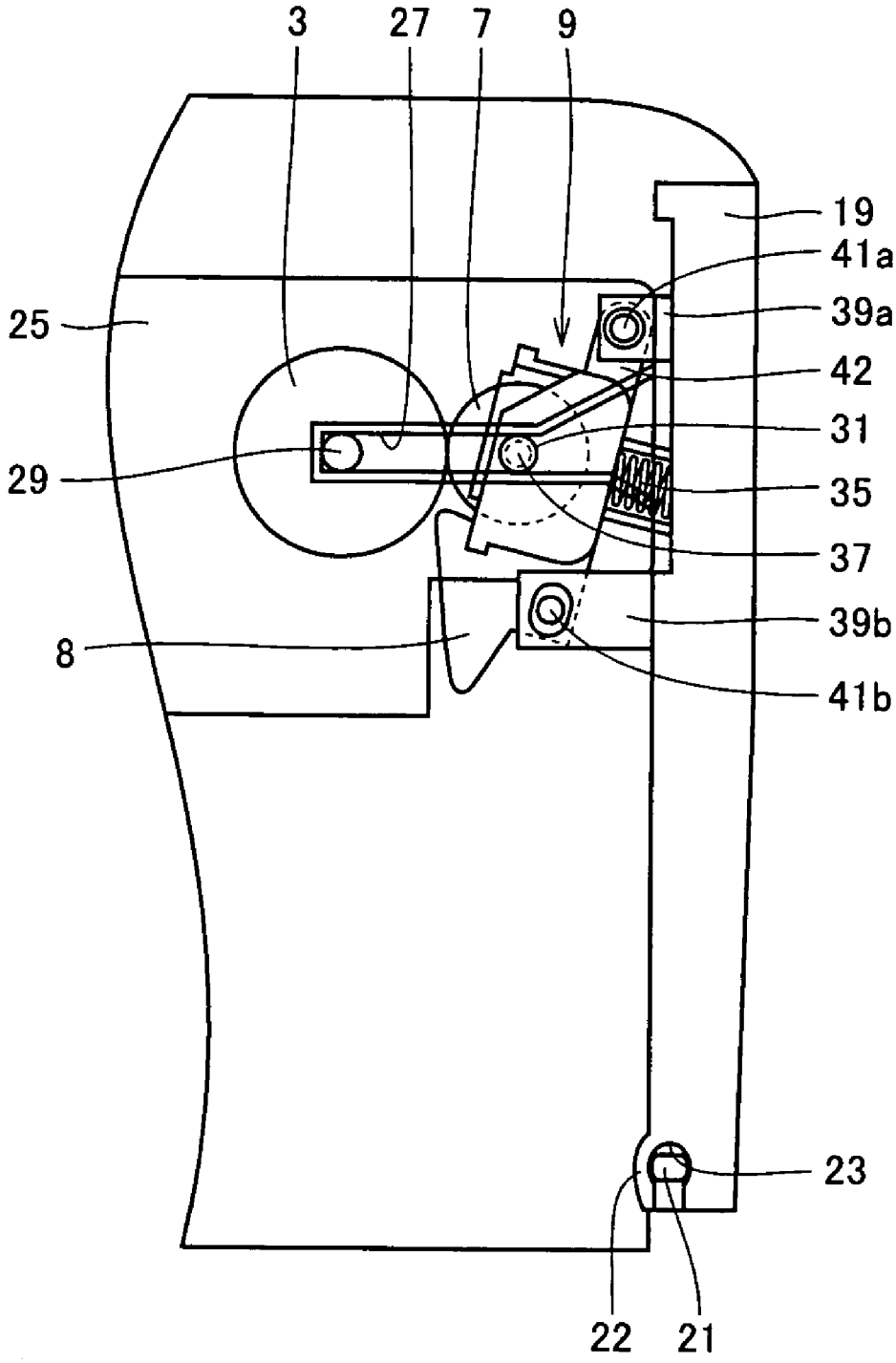
FIG. 8 is a partial schematic cross-sectional view showing a second embodiment of a printer in accordance with the present invention.

Referring to FIG. 8, a second embodiment of a printer in accordance with the present invention will be described. It is noted that FIG. 8 corresponds to FIG. 4.

A printer 1 shown in FIG. 8 has basically a structure similar to the first embodiment of the printer in accordance with the present invention as shown in FIGS. 1-7 but differs in the arrangement of a guide convex portion 31 in a transfer roll unit 9. More specifically, in printer 1 shown in FIG. 8, guide convex portion 31 is formed coaxially to a roll shaft 37 of a transfer roll 7 in a transfer roll unit 9 (at an overlapping position).

In this manner, roll shaft 37 of transfer roll 7 (the rotation axis of transfer roll 7) is positioned relative to guide member 25. Therefore, in addition to the effect similar to that of printer I shown in the first embodiment of the present invention, such a problem is less likely to occur in that the relative position between drum 3 and transfer roll 7 is shifted due to distortion of the housing of transfer roll unit 9.

Third Embodiment

Figure 9:
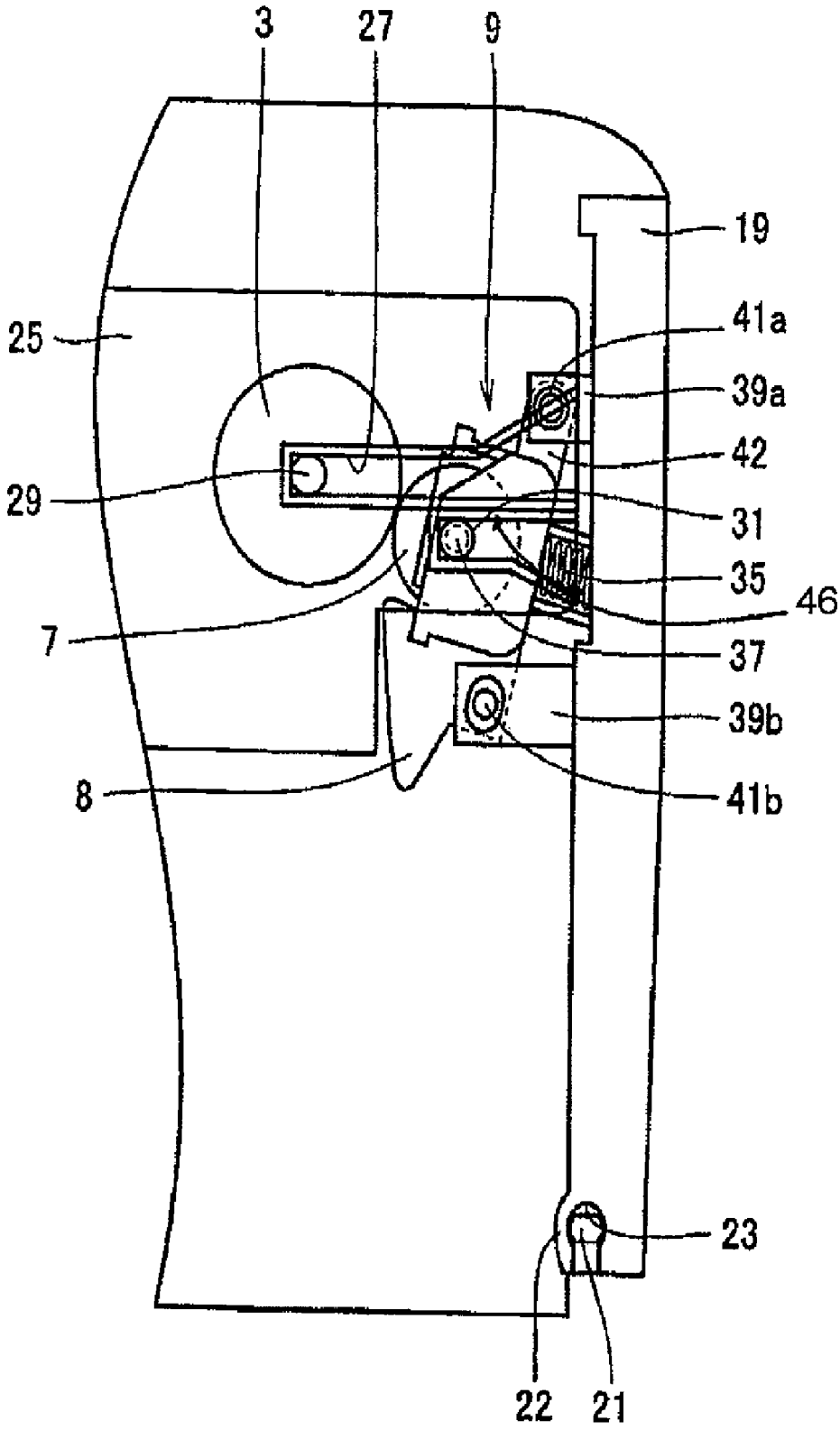
FIG. 9 is a partial schematic cross-sectional view showing a third embodiment of a printer in accordance with the present invention.

Referring to FIG. 9, a third embodiment of a printer in accordance with the present invention will be described. It is noted that FIG. 9 corresponds to FIG. 8.

A printer shown in FIG. 9 basically has a structure similar to that of the printer shown in FIG. 8 but differs in the structure of guide member 25. More specifically, in a printer 1 shown in FIG. 9, a guide member 25 is provided with, besides a guide groove 27 for fixing a drum shaft 29 of a drum 3, another groove 46 for fixedly inserting a guide convex portion 31 of a transfer roll unit 9. In this way, guide groove 27 for fixing drum 3 and another groove 46 for positioning transfer roll 7 are separately formed, so that the arrangement of guide groove 27 and another groove 46 can be changed arbitrarily, in addition to the effect resulting from printer 1 shown in the second embodiment of the present invention. Therefore, the relative position between drum 3 and transfer roll 7 can be changed arbitrarily. As a result, the degree of design freedom of printer 1 can be increased.

The characteristic configuration of a printer as an exemplary image forming device in accordance with the present invention as described above will now be described exhaustively although there may be a partial overlap with the description of the embodiments above.

Printer 1 as an image forming device in accordance with the present invention includes housing 2 having openable/closable door 19, drum 3 as a photoconductive drum for forming an image, guide member 25, and transfer roll 7 as a carrying member. Drum 3 is arranged inside housing 2 at a part adjacent to door 19. Guide member 25 has a fixed relative position to drum 3. Transfer roll 7 is provided to door 19 and arranged to be adjacent to drum 3 when door 19 is in a closed state. Guide convex portion 31 as a position determining portion for determining the position of transfer roll 7, and guide groove 27 or another groove 46 (see FIG. 9) of guide member 25 are formed such that the relative position of transfer roll 7 to guide member 25 is fixed when door 19 is in a closed state.

In this manner, the relative position of transfer roll 7 to drum 3 can be fixed through the guide member by means of guide convex portion 31 and guide groove 27 or another groove 46. Therefore, such a problem is less likely to occur in that the relative position between transfer roll 7 and drum 3 is shifted to cause a shift (for example, a skew) in the carrying direction of recording paper that is carried to drum 3 by transfer roll 7. It is noted that although a roll-like member such as transfer roll 7 may be used as a carrying member, a member having any other shape (for example, a carrying belt or a guide member that guides the direction of travel of recording paper) may be used.

The aforementioned printer 1 may further include a housing for transfer roll unit 9 serving as a holding member provided at door 19 and holding transfer roll 7. The position determining portion as described above may include guide groove 27 or another groove 46 in FIG. 9 as a groove formed in guide member 25, and guide convex portion 31 as a convex portion formed in the housing of transfer roll unit 9. Guide convex portion 31 may be inserted to be fixed in guide groove 27 or another groove 46 when door 19 is in a closed state.

In this case, transfer roll unit 9 can be positioned automatically to guide member 25 by bringing door 19 into a closed state. Therefore, the relative position of transfer roll 7 held in the housing of transfer roll unit 9 with respect to guide member 25 can easily be determined. Thus, the relative position of transfer roll 7 to drum 3 can be determined and fixed through the guide member 25.

In the aforementioned printer 1, drum 3 may have drum shaft 29 formed as the axis about which drum 3 rotates. As shown for example in FIG. 1, the end portion of drum shaft 29 of drum 3 is fixedly inserted into guide groove 27 so that the relative position between guide member 25 and drum 3 may be fixed. In this case, guide groove 27 formed in guide member 25 for use to position transfer roll 7 may also be used to position drum 3. Therefore, the structure of guide member 25 can be simplified as compared with the case where a separate structure for positioning drum 3 to guide member 25 is formed, for example, as shown in FIG. 9.

In the aforementioned printer 1, drum 3 may have drum shaft 29 formed as the axis about which drum 3 rotates. As shown in FIG. 9, guide member 25 may have guide groove 27, besides another groove 46 as described above, formed as a groove for the photoconductive drum for inserting the end portion of drum shaft 29 of drum 3. Drum shaft 29 of drum 3 is fixedly inserted into guide groove 27 so that the relative position between guide member 25 and drum 3 may be fixed.

In this case, another groove 46 that is a groove for positioning transfer roll 7 to guide member 25 and guide groove 27 as a groove for the photoconductive drum for positioning drum 3 to guide member 25 are separately formed. Thus, as compared with the case where one groove is used as another groove 46 as described above and guide groove 27, the degree of design freedom can be increased for the relative position between transfer roll 7 and drum 3 and guide member 25. Accordingly, the degree of design freedom can be increased also for the relative position between drum 3 and transfer roll 7.

In the aforementioned printer 1, transfer roll 7 as a carrying member has a transfer roll shaft (roll shaft 37) serving as the center of rotation. As shown in FIG. 8 or FIG. 9, guide convex portion 31 may be formed at a position coaxial to roll shaft 37. In this case, roll shaft 37 is arranged such that it overlaps with guide convex portion 31 that is a fixing portion for fixing transfer roll 7 (or transfer roll unit 9) to guide member 25. Thus, when stress is applied to transfer roll 7, the stress can smoothly be transmitted to guide member 25 through roll shaft 37 and the fixing portion (guide convex portion 31). Therefore, such a problem is less likely to occur in that the stress applied to transfer roll 7 causes local deformation of transfer roll 7.

In the aforementioned printer 1, door 19 pivots about door connection portion 22 and pivot 21 as a connection portion with housing 2 so that it can be opened and closed. Door 19 may be movable in the direction that intersects the direction of pivoting about door connection portion 22 and pivot 21 (the direction indicated by arrow 47 in FIG. 5). In this case, even if there is some manufacturing error in the dimension of door 19 or guide member 25, door 19 moves in the direction indicated by arrow 47 when door 19 is brought into a closed state, whereby the position of door 19 can be adjusted finely. Therefore, door 19 can surely be brought into a closed state.

In the aforementioned printer 1, the connection portion may include pivot 21 as a connecting convex portion formed at housing 2 and door connection portion 22 as a door portion having opening portion 23 for fixedly inserting pivot 21. Width T4 (see FIG. 7) of opening portion 23 in the direction (the direction indicated by arrow 47 in FIG. 5) that intersects the pivoting direction of door 19 (the direction indicated by arrow 44 in FIG. 5) may be greater than width T3 (see FIG. 6) of opening portion 23 in the direction along the pivoting direction of door 19 (the direction indicated by arrow 44 in FIG. 5, or the direction vertical to the direction indicated by arrow 47). In this case, with the simple configuration as described above, door 19 can be realized that is movable in the direction indicated by arrow 47 that intersects the direction indicated by arrow 44 that is the pivoting direction.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming device comprising:

a housing having an openable/closable door;

a photoconductive drum for image formation arranged inside said housing at a part adjacent to said door and having a shaft serving as a center of rotation;

a guide member having a groove;

a transfer roll held in a holding member provided at said door and arranged to be adjacent to said photoconductive drum when said door is in a closed state; and a pressurizing member for pressurizing said transfer roll to a direction of said photoconductive drum, wherein an end portion of the shaft of said photoconduetive drum is fixedly inserted into said groove whereby a relative position between said guide member and said photoconductive drum is fixed, said holding member is provided with a convex portion, the convex portion of said holding member is inserted to be fixed in said groove such that a relative position of said transfer roll to said guide member is fixed when said door is in a closed state, and said door pivots about a connection portion with said housing so that said door can be opened and closed, said connection portion including a connecting convex portion formed at said housing, and an opening portion formed at said door for fixedly inserting said connecting convex portion, wherein a width of said opening portion in a direction that intersects a pivoting direction of said door is greater than a width of said opening portion in a direction along the pivoting direction of said door.

2. An image forming device comprising:

a housing having an openable/closable door;

a photoconductive drum for image formation arranged inside said housing at a part adjacent to said door;

a guide member with a relative position to said photoconductive drum being fixed;

a carrying member provided at said door and arranged to be adjacent to said photoconductive drum when said door is in a closed state, wherein a position determining portion for determining a position of said carrying member is formed such that a relative position of said carrying member to said guide member is fixed when said door is in a closed state; and a holding member provided at said door for holding said carrying member, wherein said position determining portion includes a groove formed at said guide member, and a convex portion formed at said holding member and inserted to be fixed in said groove when said door is in a closed state.

3. The image forming device according to claim 2, wherein said photoconductive drum has a shaft formed as a center of rotation, and an end portion of said shaft of said photoconductive drum is fixedly inserted in said groove whereby a relative position between said guide member and said photoconductive drum is fixed.

4. The image forming device according to claim 2, wherein said photoconductive drum has a shaft formed as a center of rotation, said guide member has, besides said groove, a groove for the photoconductive drum for inserting an end portion of said shaft of said photoconductive drum, and said shaft of said photoconductive drum is fixedly inserted in said groove for the photoconductive drum whereby a relative position between said guide member and said photoconductive drum is fixed.

5. The image forming device according to claim 2, wherein said carrying member is a transfer roll, said transfer roll has a transfer roll shaft formed as a center of rotation, and said convex portion is formed at a position coaxial to said transfer roll shaft.

6. The image forming device according to claim 2, wherein said door pivots about a connection portion with said housing so that said door can be opened and closed, and said door is movable in a direction that intersects a direction of pivoting about said connection portion.

7. An image forming device comprising:

a housing having an openable/closable door;

a photoconductive drum for image formation arranged inside said housing at a part adjacent to said door;

a guide member with a relative position to said photoconductive drum being fixed; and a carrying member provided at said door and arranged to be adjacent to said photoconductive drum when said door is in a closed state, wherein a position determining portion for determining a position of said carrying member is formed such that a relative position of said carrying member to said guide member is fixed when said door is in a closed state;

wherein said door pivots about a connection portion with said housing so that said door can be opened and closed, said door is movable in a direction that intersects a direction of pivoting about said connection portion, said connection portion includes a connecting convex portion formed at said housing, and a door portion formed at said door and having an opening for fixedly inserting said connecting convex portion, wherein a width of said opening portion in a direction that intersects a pivoting direction of said door is greater than a width of said opening portion in a direction along the pivoting direction of said door.

* * * * *

UNITED STATES PATENT AND TRADEMARK OFFICE

CERTIFICATE OF CORRECTION

PATENT NO. : 7,430,385 B2
APPLICATION NO. : 11/266997
DATED : September 30, 2008
INVENTOR(S) : Masanori Yamaoka It is certified that error appears in the above-identified patent and that said Letters Patent is hereby corrected as shown below:

In the Claims:

In Claim 1, column 8, line 15, the word "photoconduetive" should be

--photoconductive--.

Signed and Sealed this

Fourteenth Day of April, 2009

JOHN DOLL
*Acting Director of the United States Patent and Trademark Office*